United States Patent [19]

Rampalli et al.

[11] Patent Number: 4,800,351

[45] Date of Patent: Jan. 24, 1989

[54] RADIATING COAXIAL CABLE WITH IMPROVED FLAME RETARDANCY

[75] Inventors: Sitaram Rampalli, Tinley Park; Hugh R. Nudd, Mokena, both of Ill.

[73] Assignee: Andrew Corporation, Orland Park, Ill.

[21] Appl. No.: 95,015

[22] Filed: Sep. 10, 1987

[51] Int. Cl.[4] ..... H01P 3/06; H01Q 13/00

[52] U.S. Cl. ..... 333/237; 174/121 A

[58] Field of Search ..... 333/237, 243; 174/121 A

[56] References Cited

U.S. PATENT DOCUMENTS

| | | | |
|---|---|---|---|
| 3,823,255 | 7/1974 | La Gase et al. | 174/121 A X |
| 4,280,225 | 7/1981 | Willis . | |
| 4,284,842 | 8/1981 | Arroyo et al. | 174/121 A X |
| 4,659,871 | 4/1987 | Smith et al. | 174/121 A X |

OTHER PUBLICATIONS

Pedersen et al., Low-Smoke, Halogenfree Ship-Offshore/Onshore Cables With Improved Flame Retardance and Fire Resistance, International Wire & Cable Symposium Proceedings 1983, pp. 200-220.

Bertsch et al., New Mica Paper Insulation for Fire Resistant Cables, Cogebi, Belgium.

Palmer et al., Light Weight Polyimide Film/Mica Marine Cable, International Wire & Cable Symposium Proceedings 1985, pp. 250-225.

Pedersen, Halogenfree Cables for Ships and Offshore Oil Platforms Electrical Commnnication, vol. 59, No. 4, 1985, pp. 365-368.

Og. 7 of BICC Catalog, Cableselector No. E28.

*Primary Examiner*—Paul Gensler

*Attorney, Agent, or Firm*—Stephen G. Rudisill

[57] ABSTRACT

A radiating cable of the foam dielectric type is provided with increased flame-retardant capabilities by provision of an inert barrier tape between an apertured, corrugated outer conductor and the external jacket surrounding the conductor. The barrier tape is composed of non-halogenated, self-extinguishing insulating material and is wrapped over the outer conductor in such a way as to completely cover the radiating apertures disposed thereupon. The barrier tape prevents the melting and bubbling of the dielectric foam outwardly through the radiating slots into penetrating contact with the external jacket when the cable is subjected to high-intensity flames, without significantly affecting the transmission characteristics of the cable.

6 Claims, 1 Drawing Sheet

RADIATING COAXIAL CABLE WITH IMPROVED FLAME RETARDANCY

FIELD OF THE INVENTION

The present invention generally relates to coaxial cables for use with communication systems. More particularly, this invention relates to radiating coaxial electric cables formed with foam dielectric material and which exhibit high flame retardant properties.

BACKGROUND OF THE INVENTION

The use of coaxial cables of either the foam or air dielectric type is widespread for antenna feeding arrangements in communication systems. Typical applications include antenna systems for terrestrial microwave systems, cellular and land mobile radio, broadcast transmitting antenna systems, earth-station antenna systems, and high-frequency communication systems. Such coaxial cables function essentially to transmit electrical signals from a generating station to some form of antenna from where the signals are radiated. Coaxial cables of the radiating kind, on the other hand, are designed to themselves functions as continuous antennas so that electrical or radio signals are transmitted directly from the cables rather than from an antenna. Such radiating or "leaky" coaxial cables serve as efficient and economical sources for transmitting radio signals where the use of conventional antennas is impractical. Radiating cable systems are particularly indispensible in two-way mobile radio, radio paging and other localized broadcasting services in applications involving extended underground installations such as railways, mines and tunnels where conventional centralized VHF and UHF communication systems are not practical.

Regardless of the particular application, a common requirement of coaxial cables is high retardancy to flame propagation. Over-heating of cables when subjected to current overloads or related system failures can initiate fires. More importantly, when electrical equipment has already been subjected to fire, the cables used therein may themselves contribute to flame propagation and also produce noxious fumes and smoke. Foam dielectric coaxial cables are particularly suited to antenna feeder systems which do not require a pressure path to the antenna and are hence often specified in applications using land mobile radio, cellular radio, or terrestial microwaves links; in such applications it is important that the cables do not in any way contribute to flame propagation in case of fire.

For quite some time coaxial cables have been afforded flame retardant properties by sheathing cables with halogen-containing materials such as polyvinyl chloride (PVC) or other flouroplastic materials. Such cables resist fire propagation even under severe heat conditions; however, upon being exposed to fire the halogen containing materials in the sheaths generate noxious smoke and form toxic and corrosive gases. Beside being a substantial safety hazard, the use of such cables leads to secondary damages resulting from degrading of the fire-retardant material.

Flame retardant cables based on halogen-free materials such as olefin-copolymers and other high oxygen index materials have subsequently been developed. Improved flame retardant and fire resistant properties are provided by such cables by the process of cross-linking the halogen-free materials. A major problem with such cables is that they are extremely expensive and generally stiff and unpliable.

A problem peculiar to radiating cables of the foam-dielectric type arises due to the very construction of such cables. In a radiating cable, slots or other apertures are provided in the outer conductor to allow a controlled portion of the transmitted RF signal to radiate, thus creating elemental radiating sources along the entire length of the cable. The outer conductor itself surrounds an assembly consisting of a foam core extruded onto an inner conductor. The entire coaxial assembly is then jacketed with a flame retardant material. With this type of construction, when the cable is subjected to high heat conditions in a fire, the foam inside the cable melts and bubbles out of the apertures in the outer conductor and can penetrate the softened external jacket so as to be exposed to the fire. Consequently, flames propagate rapidly along the cable and can lead to total destruction of the cable. As a result, most existing radiating cables are incapable of passing stringent flame tests such a the IEEE 383 test.

SUMMARY OF THE INVENTION

It is a primary object of this invention to provide a radiating cable of the foam dielectric type with improved flame retardant characteristics.

In this regard, it is a related object of this invention to provide a highly flame retardant radiating cable which exhibits self-extinguishing properties and does not contribute to flame propagation along the length of the cable even when exposed to high intensity flame conditions.

A further object of this invention is to provide a radiating cable of the above kind which can be constructed of non-halogenated material.

Yet another object is to provide radiating cable of the above kind in which the foam dielectric contained therein is prevented from melting and bubbling out of the supported jacket.

A further object is to provide a radiating cable with all the above characteristics which is economical and relatively simple to manufacture and which is conveniently flexible and pliable in use.

Other objects and advantages of this invention will become apparent from the following description when taken into conjunction with the accompanying drawings.

The above objects are accomplished in accordance with this invention, by means of a radiating cable construction which utilizes at least one layer of highly flame retardant inner barrier tape between the outer conductor and the external jacket of the cable. The tape is selected to be of a material having good thermal barrier properties while at the same time having a substantially low dielectric loss and good transmission properties so that the radiation field around the slots or apertures of the outer conductor is substantially unaffected by the barrier tape itself. The provision of the barrier tape effectively contains the foam dielectric inside the cable, thereby preventing the flammable foam from contributing to the fire.

Although a variety of flame retardant barrier tapes have been used to provide additional fire retardancy to conventional coaxial cables, this approach has not been applied to tackle the problems that are peculiar to radiating coaxial cables using foam dielectric and corrugated outer conductors. Improved flame retardancy in radiating cables has been conventionally achieved by resorting to the costly cross-linking technique. In addition to using a cross-linked jacket material, the polymer material used as the dielectric itself has been cross-linked so that the foam will only char and not burn or melt when subjected to high heat. This approach not only makes the radiating cables extremely expensive but the use of cross-linked material makes the cables extremely rigid and nonpliable so that installation and working of the cables is difficult and expensive. The crosslinking process also results in the deterioration of dielectric properties of cable insulation and jacket materials. In the case of radiating cables, where signals propagate along the surface of the outer conductor close to the jacket, the application of an electrically lossy jacket material over the cable results in poor signal transmission characteristics. In the applicants, radiating cable construction, the combination of the flame retardant barrier tape and the flame retardant thermoplastic material of the jacket provides a highly flame retardant radiating cable which is devoid of cross-linked materials and at the same time is pliable so that both manufacture and installation is made inexpensive.

DESCRIPTION OF THE PREFERRED EMBODIMENT

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of this invention as defined by the appended claims.

Figure 1:
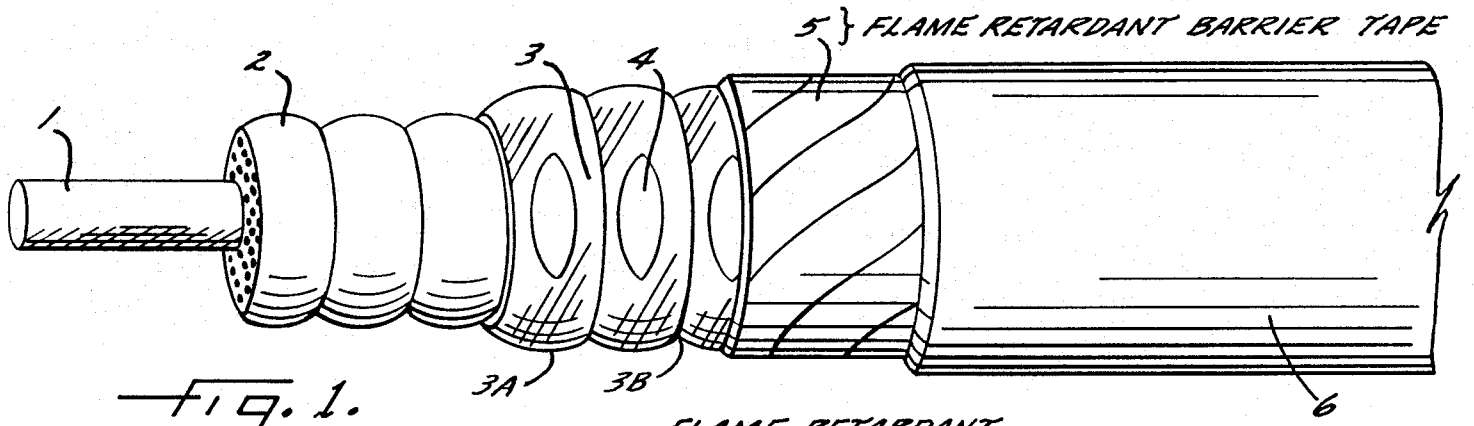
FIG. 1 is a cutaway view showing the various layers comprising a radiating coaxial cable according to this invention.

As shown in FIG. 1, the radiating cable comprises an inner conductor 1 at the center of the cable. The conductor 1 is generally of a smooth or corrugated conducting material such as copper, aluminum or copper-clad aluminum. The inner conductor 1 is surrounded by a layer of low-loss foam dielectric material 2 such as cellular polyethylene or the like. An outer conductor 3 surrounds the foam dielectric and is generally made from a corrugated copper strip which is provided with a series of slots or apertures 4 arranged along the axial length of the conductor. The slots are preferably oval in shape as shown in FIG. 1, but they can also be any other shape. The radiating apertures in the corrugated copper outer conductor permit a controlled portion of the radio frequency signals being propagated through the cable to radiate from elemental sources along its entire length so that the coaxial cable in effect functions as a continuous antenna.

The construction described so far is conventional and commonly used for radiating cables. In conventional radiating cables, a flame retardant jacket is provided over the outer copper conductor. When such cables are subjected to extreme heat conditions, the jacket material, in spite of being flame retardant, softens at higher temperatures. In addition, the foam dielectric material 2 melts at higher temperatures and as the temperature continues rising the melted foam bubbles outside the confines of the outer conductor 3 through the radiating apertures 4. The bubbling dielectric is forced against the softened outer jacket and eventually penetrates it to be exposed directly to the fire; the dielectric material feeds the fire and freely propagates flames eventually leading to complete destruction of the cable. If the dielectric material is a cross-linked polymer, the foam does not melt or bubble. Cross-linking of the jacket material, which is one method of improving the flame retardancy of non-halogenated materials, can decrease its softening tendency under fire conditions. However, cross-linking results in substantial increase in cost, loss of pliability and degradation of the transmission characteristics of the cable.

Although the use of radiating cables has been fairly common, such cables have generally been expected to pass only standard flame tests requiring merely the maintenance of circuit integrity under standard heat conditions. However, the recent proliferation of applications where radiating cables in general and foam dielectric radiating cables in particular are indispensible has resulted in increased industry awareness of their fire retardant qualities and consequently in requirements that such cables pass increasingly stringent flame retardancy tests such as the IEEE-383 test in which the emphasis is on the flame propagation characteristics of the cable. Conventional radiating cables are incapable of doing so in an economical manner.

The above-enumerated problems associated with radiating cables using a foam dielectric are solved in accordance with this invention by the provision of at least one layer of inert, flame retardant barrier tape 5 (see FIG. 1) over the corrugated outer conductor 3. An external sheath or jacket 6 made of a flame retardant non-halogenated thermo-plastic material is provided over the barrier tape 5. In effect, the tape 5 functions as a barrier between the external jacket 6 and the outer conductor 3 by virtue of which the foam dielectric 2 is efficiently contained within the conductor 3 and prevented from melting and bubbling out into contact with the jacket material. Even if the material of the outer jacket 6 softens appreciably under high heat conditions, there is no possibility of bubbling foam penetrating the jacket. Consequently, the outer jacket material can be of a less fire-retardant grade, and more significantly, there is no need for the jacket material or the dielectric core itself to be cross-linked. In addition, the provision of the inner barrier tape supplements the relatively reduced flame retardancy of the outer jacket material that results from the use of non-halogenated material, which is inherently less fire retardant compared to halogenated material.

The barrier tape is selected to be of a composition which is capable of serving as an insulating barrier even when exposed to flames with a substantially high temperature (at least up to a temperature of about 1200° C.). In addition, the tape composition is chemically inert, non-toxic and contains no halogenated substances. The composition is also preferably impervious to water, radiation resistant, acid-resistant and alkaline-resistant. It is also important that the barrier tape have good tensile strength, in addition to being dry, non-tacky, flexible and sufficiently applicable. A preferred composition for the barrier tape comprises an inorganic refractory material such as electric grade mica, which is impregnated with a heat resistant binder and combined with a suitable carrier material such as fiberglass. It is important that the refractory material display a suitably low dissipation factor when used in the cable at the frequencies at which radiating co-axial cables commonly operate. This ensures that the presence of the barrier tape does not significantly affect the electrical characteristics of the cable. Tapes satisfying the above specifications are commercially available under the trade name "FIROX" from Cogebi of Belgium.

The manufacturing process involved in producing a flame retardant radiating cable according to this invention, includes the initial step of extruding the foam dielectric core 2 (see FIG. 1) onto an accurately and appropriately sized inner conductor 1 normally made of copper. Subsequently, strip stock of the desired material, generally copper or aluminum, is formed into a tube around the previous assembly and then welded to form the continuous outer conductor 3. The outer conductor is arranged to be coaxial with the inner conductor 1 with the foam dielectric filling substantially the entire interior of the outer conductor other than the inner conductor. The outer conductor is annularly or helically corrugated (to provide cable flexibility) with any longitudinal sections thereof having alternating crests 3A and troughs 3B and the radiation apertures 4 are disposed on the crests. The above arrangement results in the material of the outer conductor 3 biting into the dielectric core in the vicinity of the corrugated troughs 3B and insures sufficient gripping action between the outer conductor and the dielectric it surrounds while being capable of accommodating differential expansion between the two. The strip of metal forming the outer conductor may contain the radiating apertures 4 of the desired shape and size before being formed and corrugated around the core assembly. Alternatively, the outer conductor may be positioned around the core assembly and corrugated before milling the radiating apertures thereupon.

At this stage, the flame retardant barrier tape 5 is wrapped around the outer conductor 3 in such a way that all the radiating apertures 4 are completely covered by the barrier tape. This wrapping is preferably performed with a fifty percent (50%) overlap so that a double layer of barrier tape is effectively provided over the radiating apertures 4. The entire assembly is subsequently jacketed by extruding the desired thermoplastic fire retardant material 6 over it.

The provision of the barrier tape constitutes a simple additional step in the overall cable manufacturing process. Since the tape is flexible and easily pliable it can be conveniently wrapped over the outer conductor. The flexible nature of the tape also insures that flexibility of the overall cable assembly is retained. Virtually any good flame retardant polymeric material can be used for forming the external jacket. However, it is preferable that the external jacket material be non-halogenated, self-extinguishing and of low dielectric loss. These properties are particularly advantageous in radiating cables. Jacket material possessing the above characteristics is commercially available from the General Electric Company under the trade name "NORYL-PX 1766".

Figure 2:
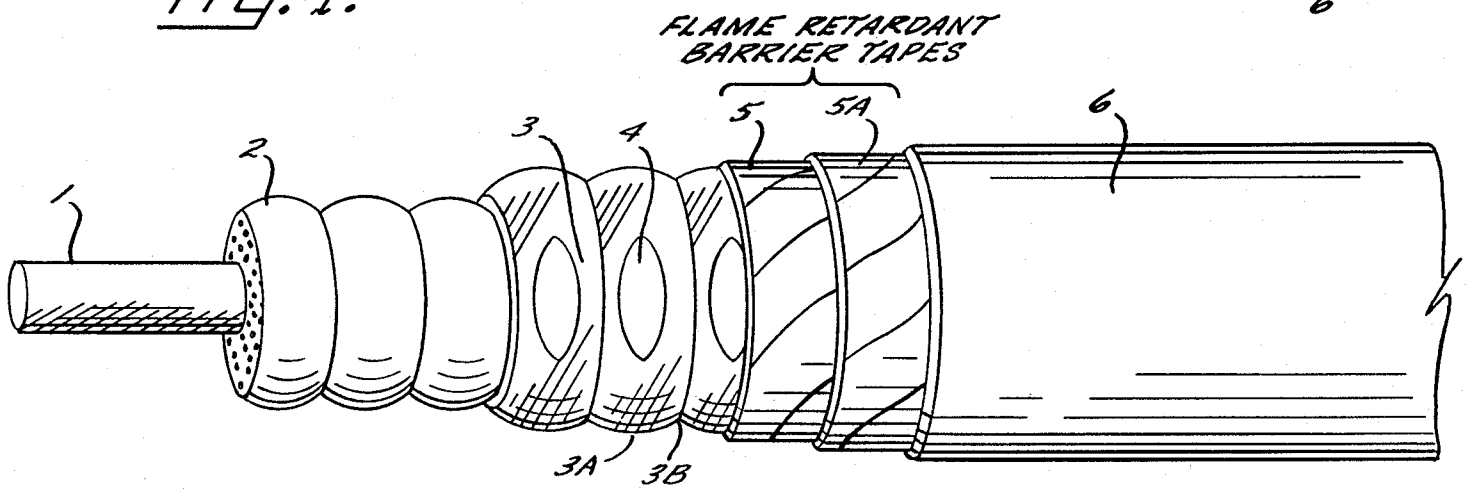
FIG. 2 is a cutaway view of a preferred embodiment of a radiating coaxial cable according to this invention.

Referring now to FIG. 2, there is shown a preferred embodiment of the flame retardant radiating cable according to this invention. This embodiment is identical to the one disclosed in FIG. 1 except for the provision of a secondary layer of barrier tape 5A wrapped over the primary layer of tape 5 which is wound directly over the outer conductor 3. The secondary layer 5A is composed- of the same barrier tape material described above in connection with FIG. 1 and is preferably wrapped with a 50% overlap. The layer 5A functions to supplement the action of the primary layer 5 in sealing the radiating apertures 4, thereby imparting increased flame retardancy without substantially affecting the transmission properties or flexibility of the cable.

It should be noted that the provision of the barrier tape on the outside of the outer conductor provides distinct advantages over wrapping the tape directly onto the dielectric core. The latter arrangement results in substantial loss of gripping action between the outer conductor and the dielectric because of the presence of the layer of tape therebetween and creates the possibility of relative lateral displacement. In addition, it is likely that the corrugation process itself and/or the subsequent milling operation for the radiation apertures will perforate or otherwise damage the barrier tape, thereby defeating the purpose of containing the dielectric material. Tests have revealed that wrapping the barrier tape onto the outer conductor results in a lower dielectric loss contribution and least affects the transmission characteristics of the cable while providing increased resistance to flame propagation; such cables have been found to conform to the IEEE-383 standard when used with outer jackets made of a lower grade fire-resistant material than would be possible with the tape wrapped onto the dielectric layer.

Radiating cables embodying the applicants, invention as set forth in the foregoing description have been consistently successful when subjected to vertical tray flame tests prescribed under Standard UL 1581 from Underwriters Laboratories Inc. This standard conforms to the well known IEEE-383 flame test, which is being increasingly required in radiating cable applications. The applicants are unaware of any commercially available radiating cables of the foam dielectric type which are capable of passing this test, except those in which both the core and the outer jacket are cross-linked.

From the foregoing, it is apparent that the applicants' invention provides a radiating cable of the foam dielectric type with significantly improved flame retardancy without the accompanying loss of economy or degradation in electrical characteristics that results from the conventional use of cross-linked polymer material for the dielectric layer and/or the protective external jacket. Radiating cables formed in accordance with this invention do not propagate flames, are easily manufactured according to conventional procedures, and are conveniently installed by virtue of their superior flexibility.

What is being claimed is:

1. A radiating coaxial electric cable of the foam dielectric type which has improved flame retardancy, said cable comprising an inner conductor; a layer of cellular foam dielectric material surrounding the inner conductor; a single, continuous, corrugated outer conductor surrounding the dielectric foam layer in direct contact therewith, said outer conductor having apertures milled in the crests of the corrugations in said outer conductor along its length for the passage of electromagnetic radiation; at least one layer of inert, flame-retardant barrier tape wrapped over the outer surface of the outer conductor so as to cover each of said radiating apertures of said outer conductor, said barrier tape comprising a particulate refractory material affixed by a heat-resistant binder to a carrier material; and a jacket of flame-retardant material extruded over the wrapped layer of tape, said tape functioning as a barrier for preventing said foam dielectric material from melting and bubbling out through said radiating apertures into penetrating contact with said extruded jacket.

2. The radiating cable of claim 1 wherein the refractory material is electric-grade mica and the selected carrier material is fiberglass.

3. The radiating cable as set forth in claim 1 wherein a first layer of said flame-retardant tape is wrapped over the outer conductor and a second layer of said tape is wrapped over said first layer so as to effectively cover said radiating apertures.

4. In a radiating coaxial cable comprising an inner conductor; a layer of cellular foam dielectric material surrounding the inner conductor; a single, continuous, corrugated outer conductor surrounding the layer of foam dielectric and including radiating apertures milled in the crests of the corrugations in said outer conductor along its length, the troughs of the corrugations of said outer conductor biting into the dielectric layer so as to restrict relative longitudinal displacement between the outer conductor and the dielectric layer; and an external jacket of flame-retardant material surrounding the outer conductor, the improvement comprising the provision of at least one layer of inert, flame-retardant barrier tape, wrapped over the outer surface of the outer conductor in such a way as to cover all radiating apertures defined thereupon, said barrier tape comprising a particulate inorganic refractory material affixed by a heat-resistant binder to a carrier material, said tape functioning as a barrier for preventing the foam dielectric material from melting and bubbling out through said radiating apertures into penetrating contact with the external jacket.

5. The improved radiating cable of claim, 4 wherein said barrier tape is composed of an inorganic refractory material such as electric-grade mica which is impregnated with a heat-resistant binder and combined with a carrier material such as fiberglass.

6. The improved radiating cable of claim 4 wherein a first layer of said flame-retardant tape is wrapped over the outer conductor and a second layer of said tape is wrapped over said first layer so as to effectively cover said radiating apertures.

* * * * *